US007431293B2

(12) United States Patent
Carter et al.

(10) Patent No.: US 7,431,293 B2
(45) Date of Patent: Oct. 7, 2008

(54) DUAL PATH ROLL FOR AN IMAGE FORMING DEVICE

(76) Inventors: Daniel L. Carter, 2704 Cincinnati Pike, Georgetown, KY (US) 40324; Robert Galon Newman, 1388 Copperfield Ct., Lexington, KY (US) 40514

( * ) Notice: Subject to any disclaimer, the term of this patent is extended or adjusted under 35 U.S.C. 154(b) by 586 days.

(21) Appl. No.: 10/790,531

(22) Filed: Mar. 1, 2004

(65) Prior Publication Data

US 2005/0189712 A1 Sep. 1, 2005

(51) Int. Cl.
*B65H 39/10* (2006.01)

(52) U.S. Cl. ..... 271/303; 271/225; 271/184

(58) Field of Classification Search ..... 271/303, 271/902, 185, 225, 184, 186, 65
See application file for complete search history.

(56) References Cited

U.S. PATENT DOCUMENTS

| | | | | |
|---|---|---|---|---|
| 4,228,996 | A | 10/1980 | Wilcox, Jr. | |
| 4,300,758 | A | 11/1981 | Peter, III | |
| 4,660,963 | A | 4/1987 | Stemmle | |
| 4,699,365 | A | 10/1987 | Smith et al. | |
| 4,793,605 | A | 12/1988 | Tajima | |
| 4,901,117 | A | 2/1990 | Derrick | |
| 4,979,727 | A * | 12/1990 | Koike et al. | 271/3.03 |
| 4,986,529 | A | 1/1991 | Agarwal et al. | |
| 4,998,716 | A | 3/1991 | Okumura et al. | |
| 5,042,790 | A | 8/1991 | Miller et al. | |
| 5,093,690 | A | 3/1992 | Ohno et al. | |
| 5,153,663 | A | 10/1992 | Bober et al. | |
| 5,201,518 | A | 4/1993 | Isoda | |
| 5,234,213 | A | 8/1993 | Chen | |
| 5,263,708 | A | 11/1993 | Hacknauer | |
| 5,539,510 | A | 7/1996 | Yamashiro et al. | |
| 5,590,872 | A | 1/1997 | Oominami et al. | |
| 5,882,130 | A | 3/1999 | Kumazaki et al. | |
| 5,974,298 | A | 10/1999 | Urban et al. | |
| 6,032,949 | A | 3/2000 | Ando | |
| 6,032,950 | A | 3/2000 | Ikeda | |
| 6,152,443 | A | 11/2000 | Claramunt et al. | |
| 6,244,591 | B1 * | 6/2001 | Paulat | 271/225 |
| 6,290,410 | B1 | 9/2001 | Sunada et al. | |
| 6,574,569 | B1 * | 6/2003 | Omata et al. | 702/33 |
| 2003/0044208 | A1 * | 3/2003 | Kouno | 399/406 |

FOREIGN PATENT DOCUMENTS

| | | | |
|---|---|---|---|
| DE | 3341413 | * | 5/1984 |
| JP | 62-275965 | * | 11/1987 |
| JP | 2000-26002 | * | 1/2000 |

* cited by examiner

*Primary Examiner*—Patrick Mackey
*Assistant Examiner*—Thomas A Morrison

(57) ABSTRACT

A dual roll to move two separate media sheets simulatneously along a section of a media path. The dual roll includes a first path formed by a first nip, and a second path formed by a second nip. A drive roll forms a section of both nips. Methods of using the dual roll are also disclosed. In one embodiment, the method comprises rotating the drive roll to move a first sheet in a first direction and simultaneously moving a second sheet in a second direction.

27 Claims, 8 Drawing Sheets

DUAL PATH ROLL FOR AN IMAGE FORMING DEVICE

BACKGROUND

An important aspect of image forming devices is the number of image sides that can be printed per minute, referred to as throughput. Usually, consumers want devices with a high throughput with good print quality and reliability.

FIG. 9 illustrates one embodiment of a prior art design illustrating an output section of a media path. Media sheets having an image formed on a first side move along the first media path 100. A diverter 102 illustrated in a first position noted by solid lines, is pivoted about point 103 to direct the media sheet to output rolls 104. If the imaging on the media sheet is complete, the output rolls 104 rotate in a first direction to discharge the media sheet from the device and into an output tray 105. If a second image is to be formed on the second side, the media rolls 104 rotate in the first direction until the trailing edge of the media sheet moves past the diverter 102. At this point, diverter 102 rotates about pivot 103 to a second position noted by dotted lines to close the first media path 100 and open the duplexer path 101. The output rolls 104 reverse and rotate in a second direction to drive the media sheet into the duplexer path 101 with the trailing edge now becoming the leading edge. This concept of introducing the media sheet into the duplexer path 101 is referred to as peek-a-boo duplexing because a leading section of the media sheet extends beyond the output rolls 104 and is visible from the exterior of the device. The sheet is then pulled back into the device when the output rolls 104 reverse to the second direction.

A second media sheet moving along the first media path must not interfere with the peek-a-boo duplexing. Therefore, the second sheet must either be paused in the first media path, or delayed to ensure it does not reach the diverter 102 until the previous sheet has cleared the area. This pausing and delay timing reduces the throughput of the device.

SUMMARY

The present invention is directed to a dual roll allowing for two separate media sheets to concurrently move along a section of a media path. The dual roll includes a first path formed by a first nip, and a second path formed by a second nip. A drive roll forms a section of both nips. In one embodiment, a diverter may be adjacently positioned to direct media sheets moving towards and away from the drive roll.

DETAILED DESCRIPTION

Figure 1:
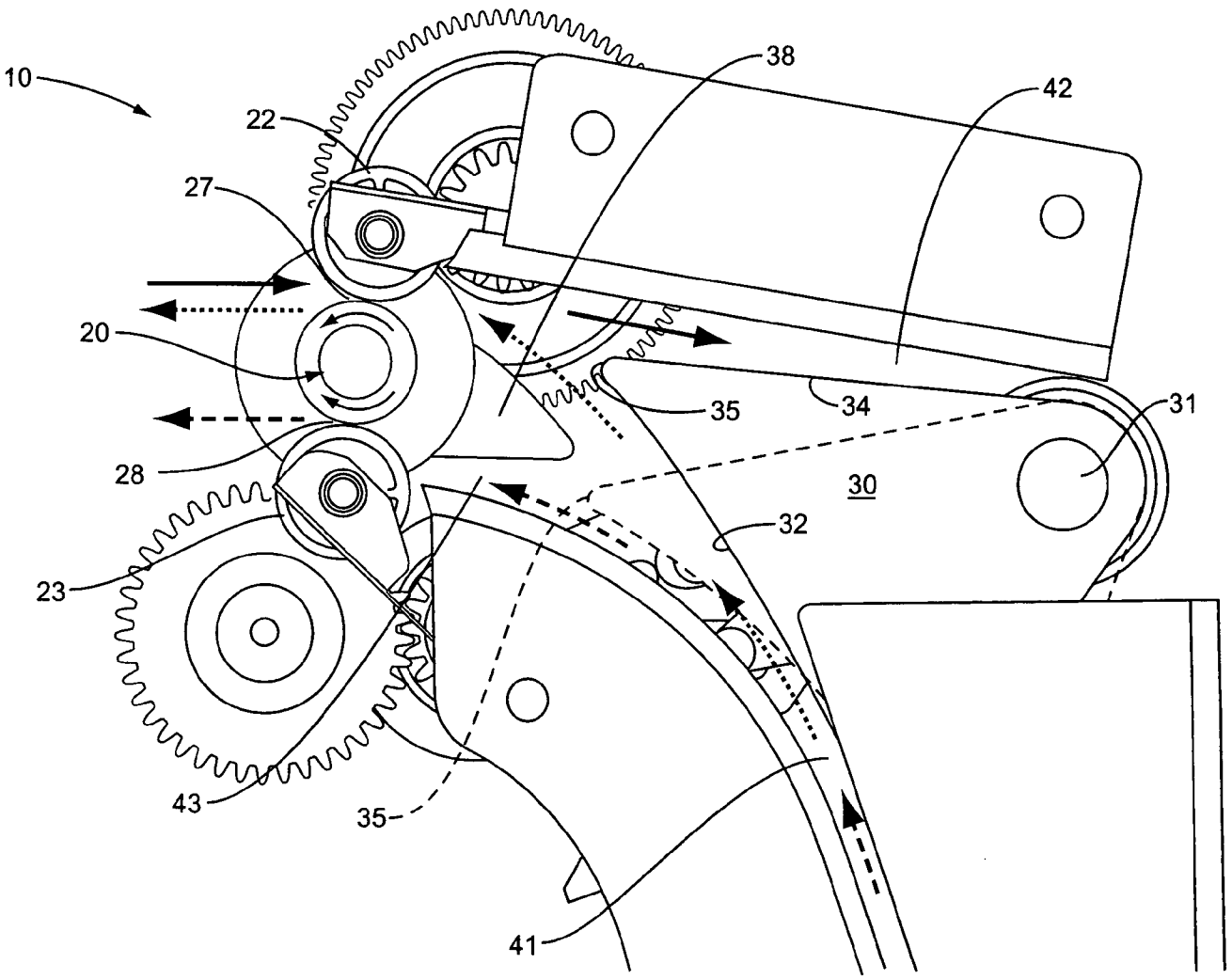
FIG. 1 is a side view of the dual roll constructed according to one embodiment of the present invention.

The present invention is directed to a dual roll, generally illustrated as 10 in FIG. 1, for two separate media sheets to concurrently move along a section of a media path. The dual roll 10 includes a first path formed by a first nip 27, and a second path formed by a second nip 28. A drive roll 20 forms a section of both nips 27, 28. A diverter 30 is adjacently positioned to direct media sheets moving towards the drive roll 20 along media paths 41 and 43, and to direct media sheets moving away from the drive roll 20 along media path 42.

The dual roll 10 is placed within the media path as illustrated in FIG. 1. The first media path 41 extends through the image forming device and leads media sheets to the dual roll 10. The second media path 42 is formed by the first nip 27 between the drive roll 20 and the first roll 22, and extends away from the dual roll 10. The third path 43 is formed by the second nip 28 between the drive roll 20 and the second roll 23.

Figure 2:
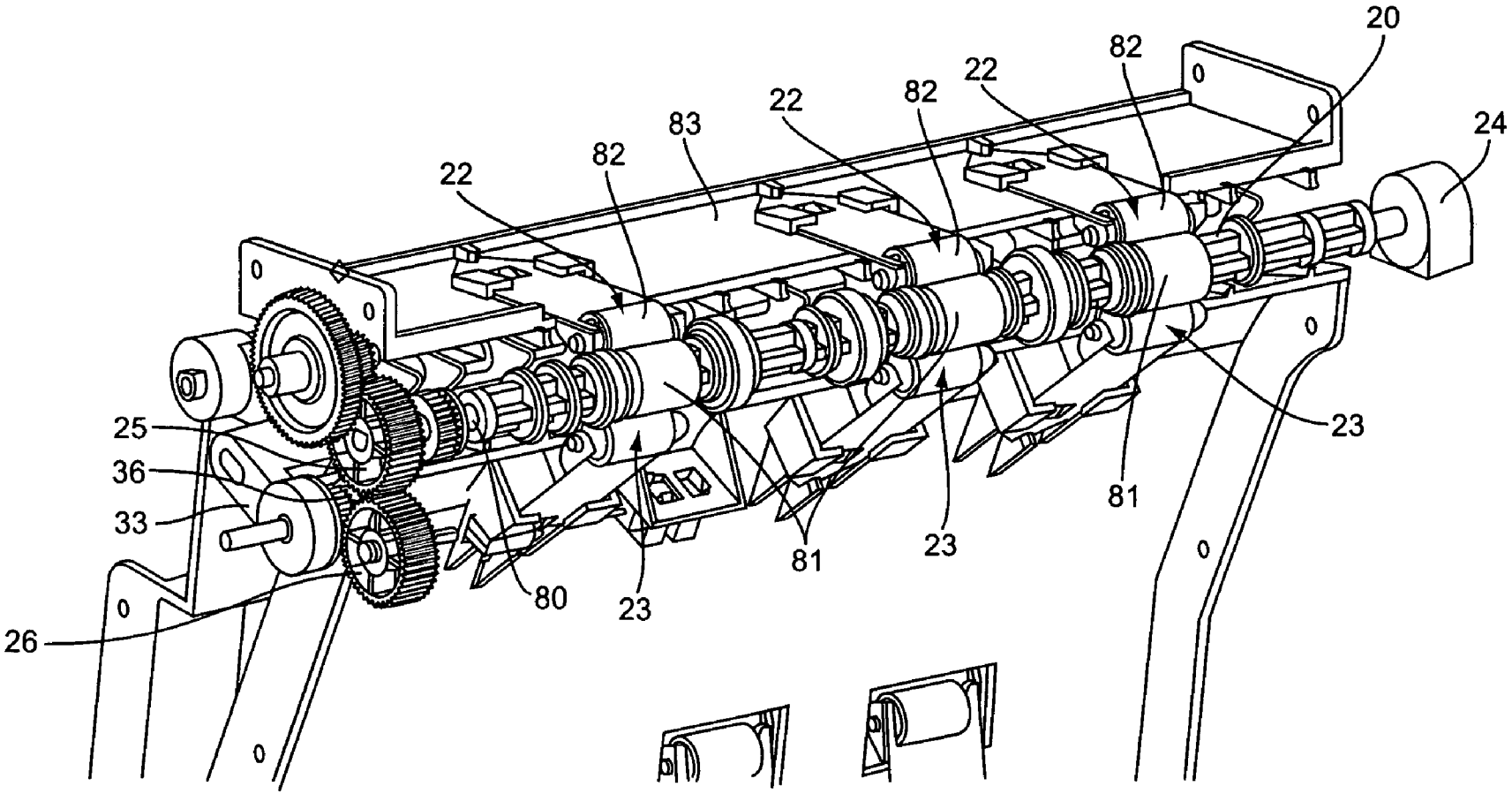
FIG. 2 is a perspective back view of the dual roll constructed according to one embodiment of the present invention.

As illustrated in FIGS. 1 and 2, drive roll 20 is positioned adjacent to a first roll 22 to form a first nip 27, and adjacent to second roll 23 to form a second nip 28. The first nip 27 is positioned above the drive roll 20, and the second nip 28 is positioned below the drive roll 20. The drive roll 20 is connected to a motor 24 for rotation in both forward and reverse directions. Motor 24 may also rotate the drive roll 20 in a variety of rotational speeds in both the forward and reverse directions. The first roll 22 and the second roll 23 are rotated through the force transferred by the contact with the drive roll 20. A first gear 25 is positioned on the drive roll 20. The first 25 gear has an outer edge with a plurality of teeth that mate with a second gear 26 as will be explained in detail below.

As illustrated in FIG. 1, diverter 30 is positioned adjacent to the dual roll 10 to direct the media sheets along the second and third paths 42, 43. Diverter 30 includes a first media edge 32 and second media edge 34 that each extend into a tip 35. In one embodiment, the edges 32, 34 form an acute angle. A guide 38 is positioned upstream from the drive roll 20 to further guide the media sheets into the first and second nips 27, 28. Guide 38 has an angular upstream configuration positioned adjacent to the tip 35. Guide 38 is fixedly positioned within the media path with a first edge aligning with the first nip 27, and a second edge aligning with the second nip 28.

An actuator arm 33 is operatively connected to the diverter 30 for controlling the position as discussed below. In one embodiment, the actuator arm 33 is connected to the diverter 30. In another embodiment, the diverter 30 is positioned in proximity to the actuator arm 33 and movement of the actuator arm 33 causes the diverter 30 to move between first and second positions.

Figure 3A:
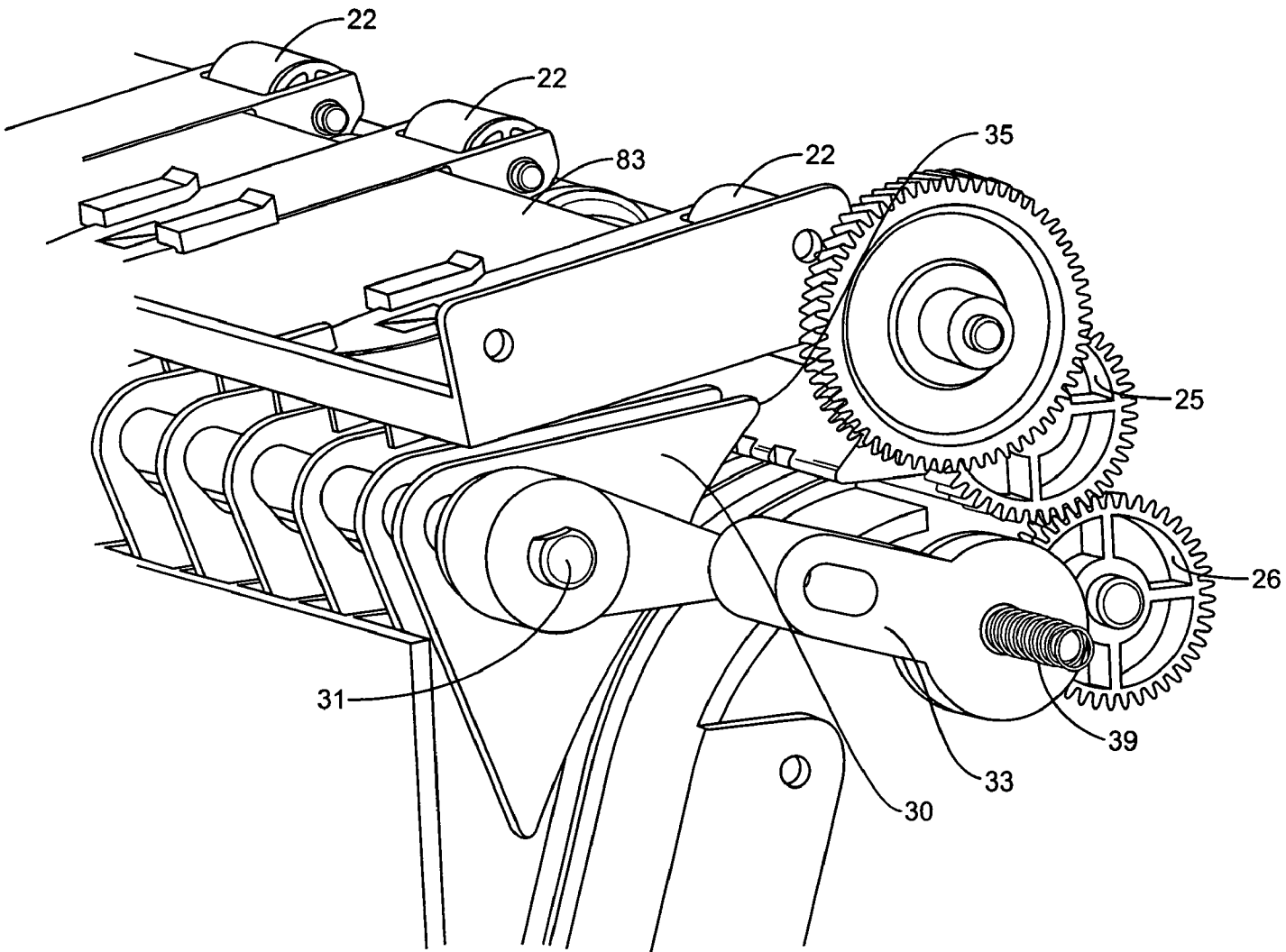
FIG. 3A is a perspective side view of the dual roll with the diverter in a first position constructed according to one embodiment of the present invention.
Figure 3B:
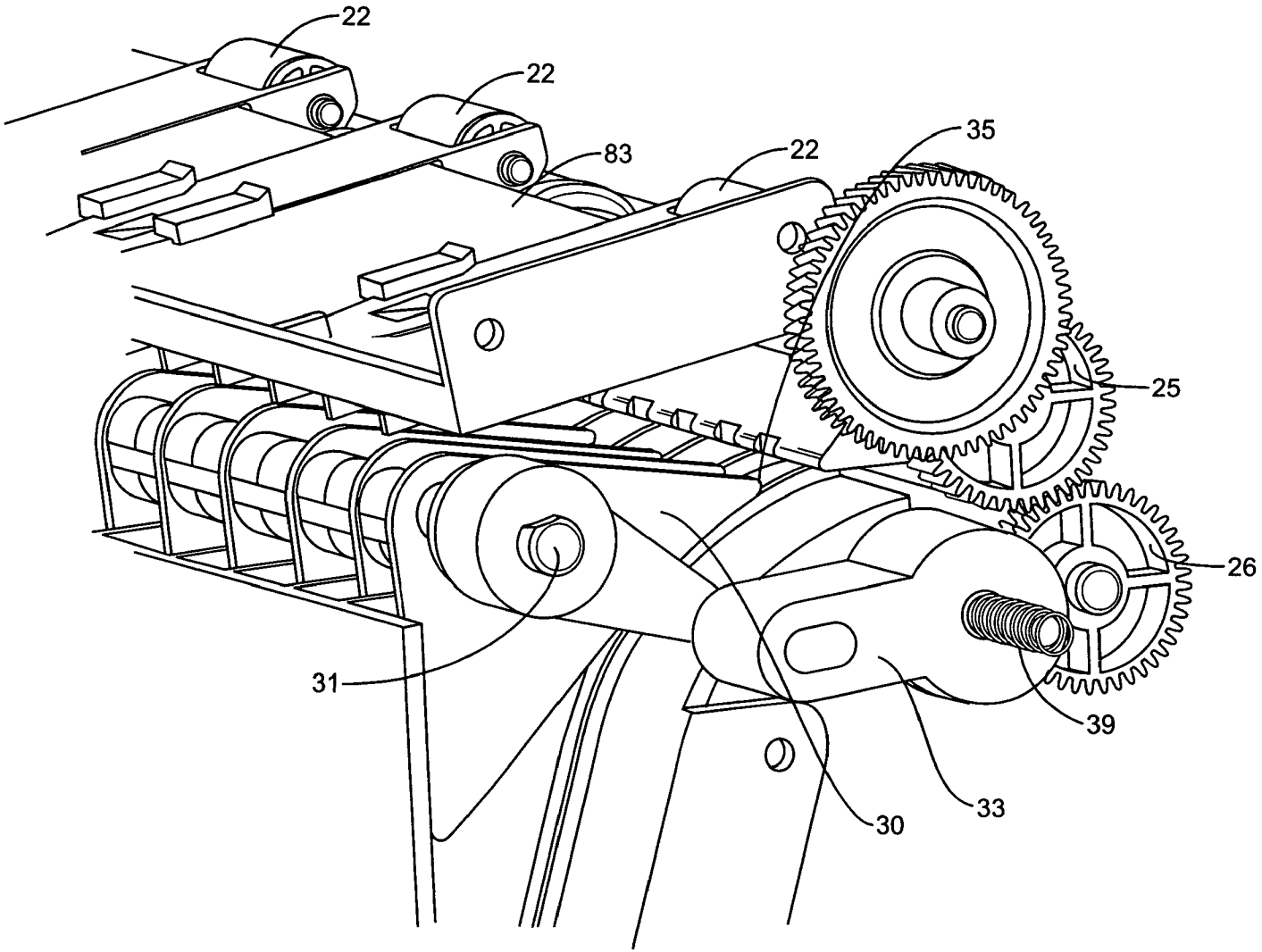
FIG. 3B is a perspective side view of the dual roll with the diverter in a second position constructed according to one embodiment of the present invention.

Diverter 30 is movably attached at a pivot 31 and positionable between the first position illustrated in solid lines in FIG. 1 and solid lines in FIG. 3A, and a second position illustrated in dashed lines in FIG. 1, and solid lines in FIG. 3B. In the first position, media sheets moving along the first path 41 ride along the first edge 32 and are directed into the second path 42 formed by the first nip 27. In the second position, media sheets moving along the first path 41 ride along the first edge 32 and are directed into the third path 43. When the diverter is in the second position, media sheets held in the first nip 27 when the drive roll 20 changes to a reverse direction are directed along the second edge 34 and along the second path 42.

The orientation of the diverter 30 is dependent upon the direction of rotation of the drive roll 20. The diverter 30 is operatively connected to the drive roll 20. In one embodiment, the diverter is operatively connected through the first gear 25, second gear 26, and actuator arm 33. First gear and second gear 25, 26 each include teeth along the outer periphery that mate together. An inner edge of the actuator arm 33 includes teeth 36 (FIG. 2) that align with the second gear 26. Therefore, the first gear 25 does not directly contact the actuator arm 33. As illustrated in FIG. 3B, when drive shaft 20 and attached first gear 25 rotate in a clockwise direction, second gear 26 rotates in a counter-clockwise direction, which in turn drives the gear teeth 36 clockwise and through a friction coupling drives the actuator arm 33 in a clockwise direction with the diverter 30 moving to one orientation. Conversely, as illustrated in FIG. 3A, when the drive shaft 20 and attached first gear 25 rotate in a counter-clockwise direction, second gear 26 rotates in a clockwise direction, and drives the gear teeth 36 counter-clockwise and through a friction coupling drives the actuator arm 33 in a counter-clockwise direction with the diverter 30 in another orientation. Therefore, the diverter 30 moves in the same direction as the drive roll 20. Preferably, the gear ratio between the first gear 25 and teeth 36 is large so that the actuator arm 33 and diverter 30 change orientations immediately upon the drive roll 20 changing rotational directions. A variety of gear trains may be used between the drive roll 20 and diverter 30. One embodiment includes using an odd number of gears between the drive roll 20 and actuator arm 33.

A friction coupling may be positioned between the gear teeth 36 and the actuator arm 33 to stop the rotation relative to the drive roll 20. In one embodiment, inner faces of the gear teeth 36 and actuator arm 33 are in contact and movement of the gear teeth 36 causes the actuator arm 33 to move in the same manner. The friction coupling may include a biasing mechanism 39 that applies a force to the actuator arm 33 to maintain the inner faces in contact. In another embodiment, a slip clutch (not illustrated) is positioned on the actuator arm 33 to prevent the rotation relative to the drive roll 20 once the actuator arm 33 and diverter 30 reach a predetermined point.

Another embodiment of operatively coupling the drive roll 20 to the actuator arm 33 is placing a pulley on the drive roll 20 and a pulley on the gear teeth 36. A belt extends around the pulleys causing the drive roll 20 and gear teeth 36 to rotate in the same direction. Another coupling embodiment includes connecting the actuator arm 33 directly to the drive roll 20.

Figure 4:
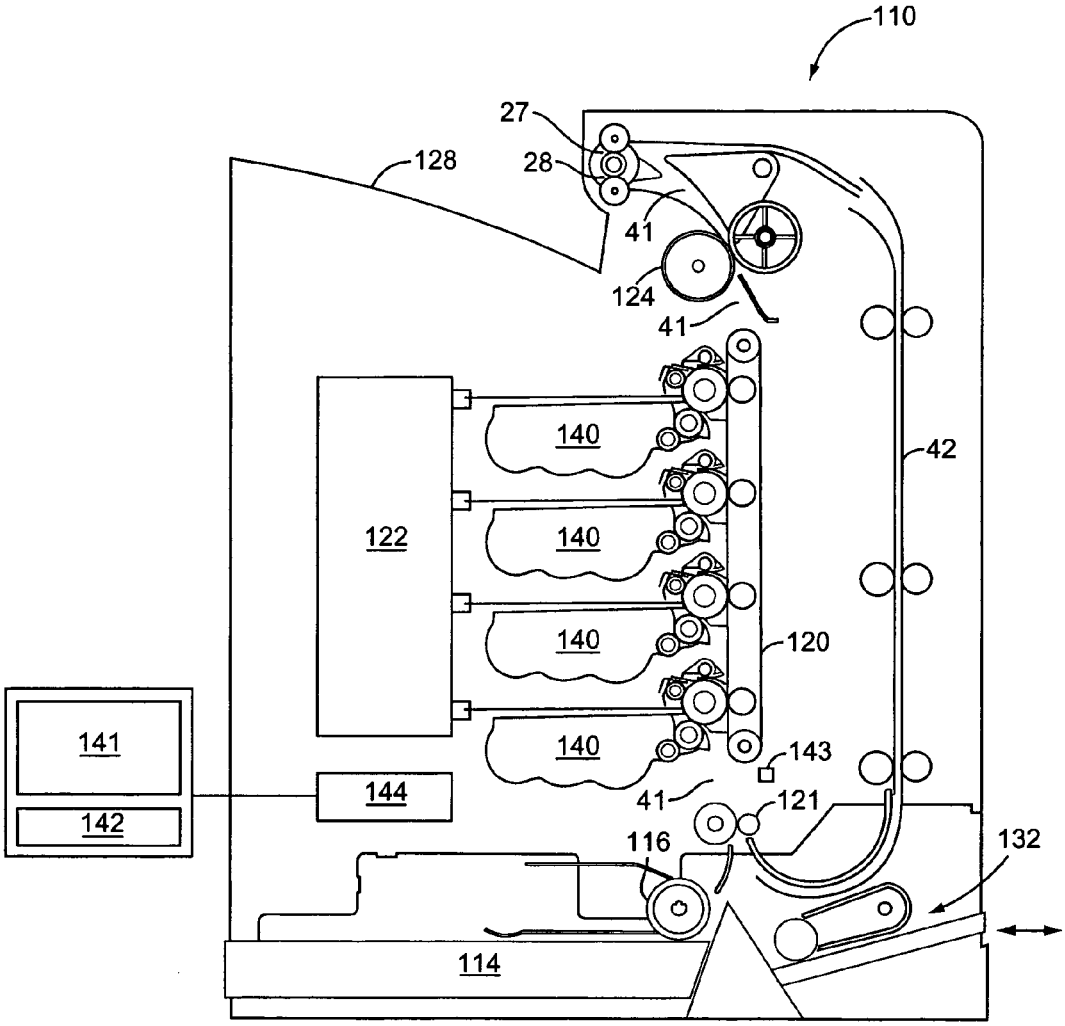
FIG. 4 is a schematic view of the dual roll positioned within an image forming device according to one embodiment of the present invention.

The dual roll 10 may be positioned at a variety of locations along the media path. FIG. 4 depicts locating the dual roll 10 at the exit point of the media path where the main media path and duplex path diverge.

The image forming device 110 includes a media tray 114 with a pick mechanism 116, or multi-purpose feeder 132, for introducing media sheets in the device 110. Media sheets are moved from the input and fed into the first path 41. One or more registration rollers 121 disposed along the first path 41 aligns the print media and precisely controls its further movement along the media path. A media transport belt 120 forms a section of the media path for moving the media sheets past a plurality of image forming units 140. Color printers typically include four image forming units 140 for printing with cyan, magenta, yellow, and black toner to produce a four-color image on the media sheet. An imaging device 122 forms an electrical charge on a photoconductive member within the image forming units 140 as part of the image formation process. The media sheet with loose toner is then moved through a fuser 124 that adheres the toner to the media sheet.

Figure 5:
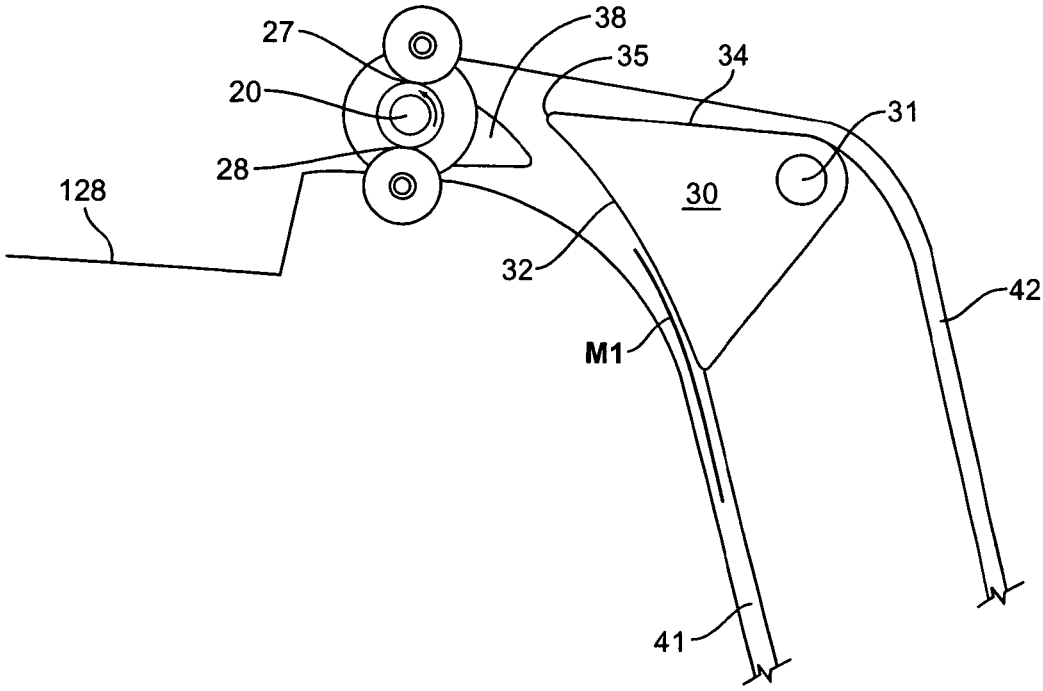
FIGS. 5-8 are schematic views illustrating the progression of media sheets moving relative to the dual roll according to one embodiment of the present invention.

As illustrated in FIG. 5, as the media sheet M1 moves along the first path 41 after passing through the fuser 124. The diverter 30 is in the first orientation and the drive roll 20 is rotated in a first direction (counter-clockwise in the embodiment of FIG. 5).

Figure 6:
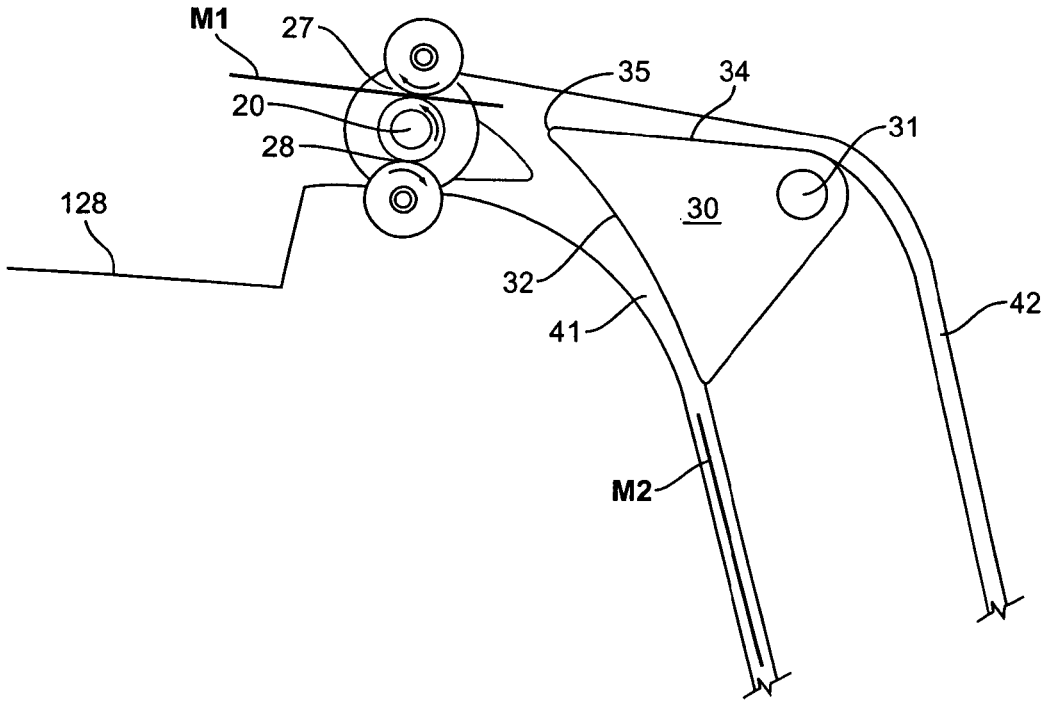

FIG. 6 illustrates the next progression as sheet M1 is positioned between the first nip 27. The drive roll 20 continues to rotate in the first direction and the leading edge of the sheet begins to extend outward from the device 110. Next, the drive roll 20 reverses direction and sheet M1 is duplexed. The direction is reversed while the sheet M1 is still within the control of the first nip 27 and after the trailing edge has cleared the diverter tip 35.

Figure 7:
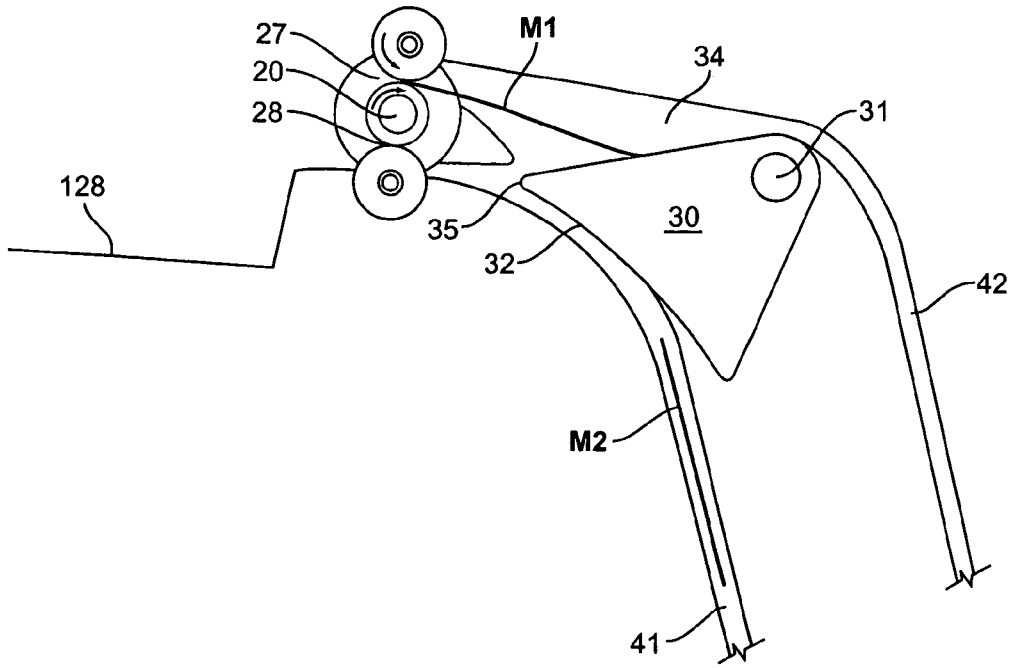

FIG. 7 illustrates the media sheet M1 being driven from the first nip 27 as the drive roll 20 is reversed to a second opposite direction (clockwise as illustrated in FIG. 7). As the drive roll 20 is reversed, diverter 30 moves to the second orientation to direct the media sheet M1 along the second path 42, and block the re-entry into the first media path 41. The gear ratio between the drive roll 20 and the diverter 30 is set such that the diverter 30 changes orientations quickly upon the change of drive roll direction. This prevents the leading edge of the media sheet from entering into the wrong media path before the diverter 30 changes orientations.

Figure 8:
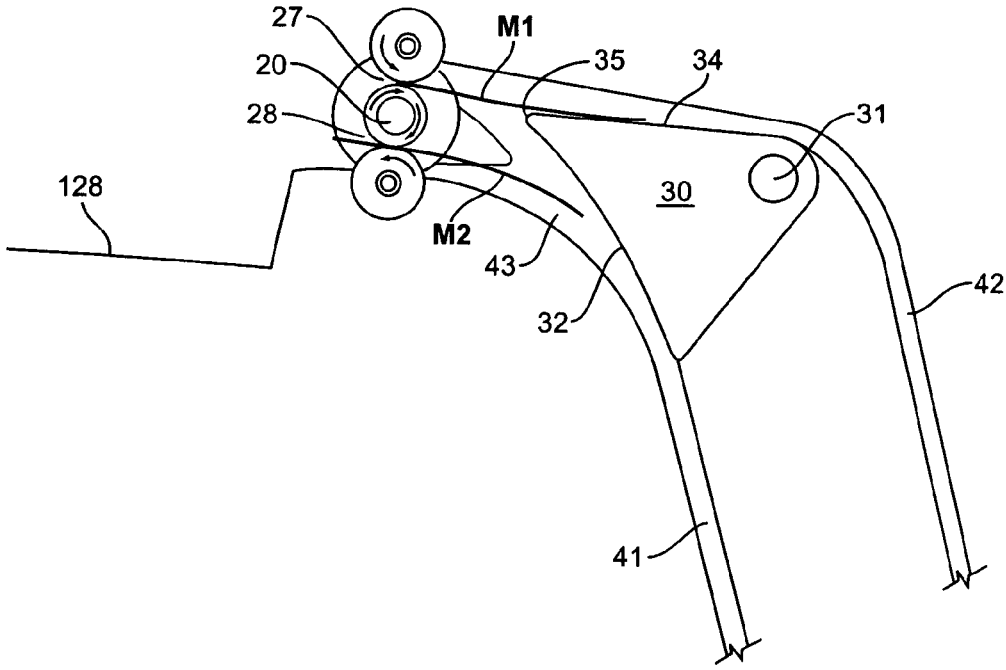
Figure 9:
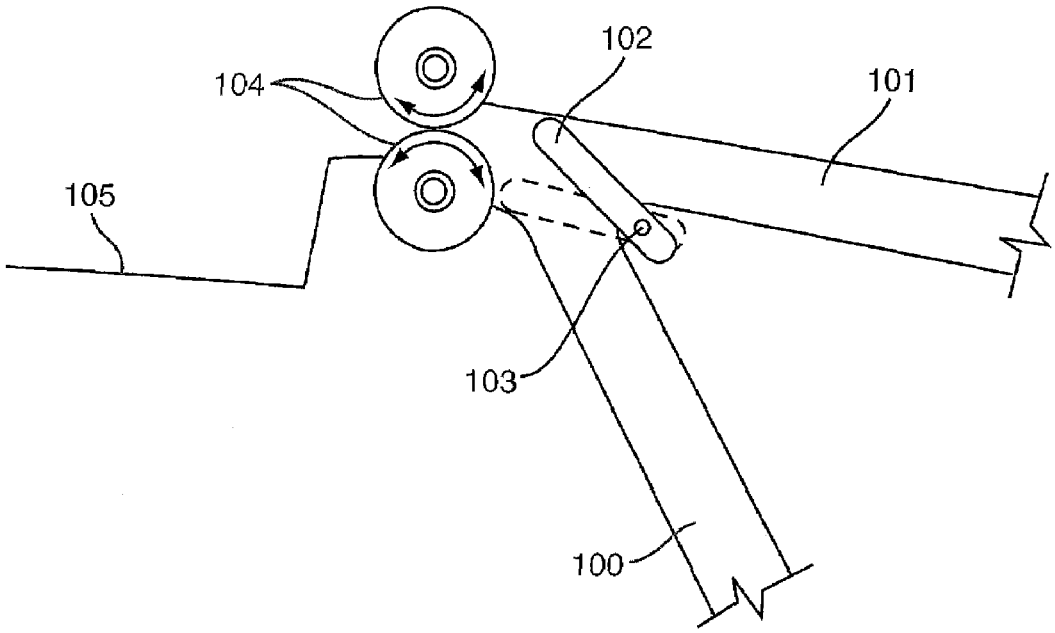
FIG. 9 PRIOR ART
FIG. 9 is a partial schematic view of an existing media path.

FIG. 8 illustrates the first media sheet M1 leaving the first nip 20 at the same time that the second media sheet M2 is entering the third path 43 formed by the second media nip 28. The drive roll 20 rotates in the second direction (i.e., clockwise in FIG. 8) to move each of the sheets M1, M2 in the correct direction. The first media sheet M1 moves along the duplex path and is re-imaged on a second side. The second media sheet M2 is output through the second nip 28 into the output tray 128.

The drive roll 20, first roll 22, and second roll 23 may have a variety of configurations. In the embodiment of FIG. 2, the drive roll 20 extends along the width of the media path. Drive roll 20 includes a central shaft 80 and a plurality of drive members 81. The drive members 81 have a larger diameter than the shaft 80 and form the nips 27, 28 with the first and second rolls 22, 23 respectively. In this embodiment, first roll 22 and second roll 23 are each a plurality of cylindrical members 82 that contact the drive members 81 of the drive roll 20. The cylindrical members 82 are mounted within a housing 83 that form a main body of the image forming device 110.

The two nips 27, 28 form two separate paths for outputting media sheets. A controller 144 oversees the movement of the media sheets as they move through the device 110. Controller 144 is programmed to determine whether the media sheets are output through first nip 27 or second nip 28. Types of controllers are found in Lexmark International, Inc. laser printer Model Nos. C750 and C752, which are herein incorporated by reference.

The controller 144 may receive various inputs to determine which of the nips 27, 28 should be used by the sheets. The ability to bend the media sheets, referred to herein as bendability, may be one such variable. Factors affecting the bendability may include the type of media (e.g., cardstock, regular paper, transparencies, etc.), and the thickness of the media sheet. In one embodiment, a sensor 143 positioned along the media path determines one or more criteria of the media sheet. Various types of sensors capable of detecting criteria of media sheets are known and may be used in the present invention. In another embodiment, the information is input by the user through an input device 142. The user may be prompted on a display 141 which may ask the type of media, thickness, etc.

The controller 144 determines the output path based on the media sheet information. The output path determination may be based on the radius of the two output paths. As illustrated best in FIG. 4, the first media path traveled by media sheets moving along path 41 from the fuser 124 through the first nip 27 has a larger radius than the second media path that extends between the fuser 124 and along path 41 to the second nip 28. Media sheets moved along the second path are bent or arched a greater degree than media sheets moving along the first media path. Therefore, a media sheet with low bendability should be output through the first nip 27 to take advantage of the softer curve of that media path. The media sheet may also be able to be output through the second nip 28, but a higher nip force in the fuser 124 and drive roll 20 are required to move the media sheet along this tighter path, and additional power may be required for the driving motors that rotate the drive roll 20 and fuser 124

In one embodiment, media sheets are normally output through the second nip 28. The first nip 27 is used when the particular media sheets have low bendability. In another embodiment, both nips 27 and 28 are used for outputting the media sheets.

Figure 10:
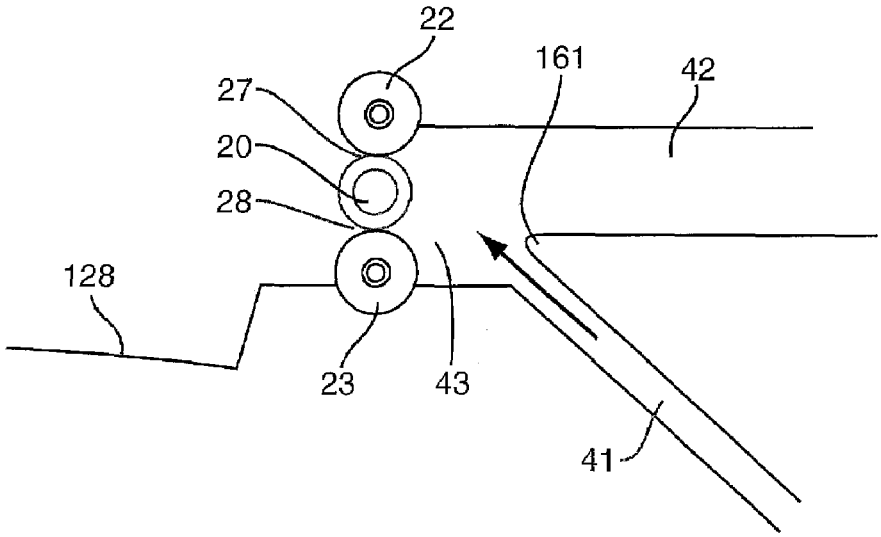
FIG. 10 is a partial schematic view of another embodiment of the dual roll according to one embodiment of the present invention.

FIG. 10 illustrates another embodiment of the dual roll. In this embodiment, there is no diverter or guide that leads the media sheets into the dual roll. The drive roll 20 forms a first nip 27 with a first roll 22 and a second nip 28 with a second roll 23. Media path 41 is positioned for media sheets to contact directly into the drive roll 20 which steers the media sheets. When the drive roll 20 rotates in a first counter-clockwise direction, the leading edge of the media sheet contacts the drive roll and is moved upward into the first nip 27. The media sheet may be completely moved beyond nip 27 to be output into tray 128. The media sheet may also be partially moved through the nip 27 until the trailing edge extends beyond an angled edge 161, and then the drive roll is reversed to rotate in a clockwise rotation to direct the media sheet into the second media path 42. A media sheet moving along path 41 that contacts the drive roll 20 moving in a clockwise rotation will be directed into the second nip 28 and output into tray 128. The dual roll design provides for two sheets to be simultaneously moved as the drive roll rotates in a clockwise direction with a first sheet in the first nip 27 being driven into the second media path 42, while a second sheet is moved into and through the second nip 28. The distance between the exit of the media path 41 and the drive roll 20 is sized such that the leading edge of the media sheet makes initial contact with the drive roll. In one embodiment, a flap is positioned across the media path 41 to prevent sheets from inadvertently re-entering the path. In one embodiment, the flap is constructed of Mylar.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A device to move media sheets simultaneously within an image forming device comprising:

a first media nip formed by a drive roll and a first roll that is positioned against the drive roll;

a second media nip formed by the drive roll and a second roll that is positioned against the drive roll;

a diverter operatively connected to the drive roll; and a gear train operatively connecting the drive roll to the diverter;

the diverter adapted to move by the gear train to a first position when the drive roll rotates in a first direction to align a first guide edge of the diverter to guide a first media sheet into the first media nip, the diverter controlled by the gear train to move to a second position when the drive roll rotates in a second direction to align a second guide edge of the diverter to guide the first media sheet out of the first media nip, and align the first guide edge of the diverter to simultaneously guide a second media sheet into the second media nip.

2. The device of claim 1, wherein the drive roll is mounted to a drive shaft, and the first roll and the second roll are each mounted to a housing of the image forming device.

3. The device of claim 1, further comprising a motor attached to the drive roll to rotate the drive roll in the first direction and the second direction.

4. The device of claim 1, wherein the first nip is formed on an upper edge of the drive roll, and the second nip is formed on a lower edge of the drive roll.

5. The device of claim 1, wherein the gear train comprises a first gear mounted to the drive roll, a second gear coupled to the diverter, and a third gear that extends between the first gear and the second gear.

6. The device of claim 1, wherein the first guide edge and the second guide edge intersect to form an acute angle.

7. The device of claim 1, wherein the diverter is positioned upstream from the drive roll.

8. The device of claim 1, wherein the diverter is positioned at an intersection of a first media path and a second media path.

9. A device to move media sheets simultaneously within an image forming apparatus comprising:

a drive roll positioned against a first roll to form a first nip and positioned against a second roll to form a second nip;

a diverter positioned completely upstream from the drive roll and operatively connected to the drive roll and having a first guide edge and a second guide edge, the diverter adapted to be positioned between a first orientation and a second orientation;

an actuator arm positioned at lateral ends of the drive roll and the diverter, the actuator arm including a first end operatively connected to the drive roll and a second end operatively connected to the diverter;

the diverter configured to be moved by the actuator arm to the first orientation when the drive roll rotates in a first rotational direction to guide along the first guide edge a first media sheet that is driven by the first nip in a first direction;

the diverter configured to be moved by the actuator arm to the second orientation when the drive roll rotates in a second rotational direction to guide along the second guide edge the first media sheet that is driven by the first nip in a second direction, and simultaneously guide a second media sheet along the first guide edge that is being driven by the second nip in the first direction.

10. The device of 9, wherein the first roll and second roll are positioned in contact with the drive roll and rotation of the drive roll rotates both the first roll and the second roll.

11. A device to move media sheets simultaneously within an image forming device comprising:

a drive roll positioned against a first roll to form a first nip and positioned against a second roll to form a second nip;

a first gear attached to the drive roll;

a second gear in contact with the first gear to rotate opposite from the first gear;

an actuator coupled to a third gear in contact with the second gear to rotate opposite from the second gear;

a diverter operatively connected to the actuator and having a first guide edge and a second guide edge, the diverter positionable between a first orientation and a second orientation;

the actuator moving to a first position when the drive roll rotates in a first rotational direction to move the diverter to the first orientation to guide along the first guide edge a first media sheet that is driven by the first nip in a first direction;

the actuator moving to a second position when the drive roll rotates in a second rotational direction to move the diverter to the second orientation to guide along the second guide edge the first media sheet that is driven by the first nip in a second direction, and simultaneously guide a second media sheet along the first guide edge that is being driven by the second nip in the first direction.

12. The device of claim 11, wherein a gear ratio between the first gear and the third gear is set for the diverter to move between the first orientation and the second orientation within a predetermined rotation of the drive roll.

13. The device of claim 11, wherein the actuator is connected to the diverter.

14. The device of claim 11, wherein the actuator is in proximity to the diverter and contacts the diverter when moving between the first position and the second position.

15. The device of claim 11, further comprising a friction coupling on the actuator to control an extent of movement in the first position and the second position.

16. A device to move media sheets within an image forming apparatus comprising:

a first media nip between a drive roll and a first roll that is positioned against the drive roll;

a second media nip formed by the drive roll and a second roll that is positioned against the drive roll;

means for determining a bendability of the media sheets;

a first media path having a first curvature and formed by an inlet path from the image forming apparatus and the first media nip, the first roll positioned on a side of the drive roll distant from the inlet path;

a second media path having a second curvature greater than the first media path, the second media path formed by the inlet path and the second media nip, the second roll positioned on a side of the drive roll adjacent to the inlet path; and a diverter operatively connected to the drive roll and controlled to divert the media sheets into the first media path when receiving a first signal from the determining means, and controlled to divert the media sheets into the second media path when receiving a second signal from the determining means.

17. The device of claim 16, wherein a distance between the inlet path and the first nip is greater than between the inlet path and the second nip.

18. A method of simultaneously moving two media sheets with a drive roll in an image forming device, the method comprising the steps of:

rotating a drive roll in a first rotational direction;

moving an actuator arm operatively connected to the drive roll to a first position and positioning a diverter in a first orientation and directing a first media sheet moving along a first media path into a first nip formed between the drive roll and a first roll;

reversing the drive roll to a second rotational direction while the first media sheet is within the first nip;

moving the actuator arm to a second position and positioning the diverter in a second orientation and directing the first sheet out of the first nip and simultaneously directing a second media sheet into a second nip formed between the drive roll and a second roll; and rotating the drive roll and simultaneously moving the first sheet in a second direction out of the first nip and moving the second sheet in a first direction out of the second nip.

19. The method of claim 18, wherein reversing the direction of the drive roll to the second rotational direction causes the diverter to move to the second orientation.

20. The method of claim 18, wherein the step of reversing the direction of the drive roll to the second rotational direction occurs after a trailing edge of the first sheet passes beyond the diverter.

21. The method of claim 18, further comprising partially extending the first media sheet out of the image forming device before reversing the drive roll to the second rotational direction.

22. The method of claim 18, further comprising rotating the drive roll and moving the first sheet in the second direction out of the first nip and into a duplexing path.

23. The method of claim 18, further comprising moving the second sheet in the first direction out of the second nip and discharging the second sheet from the image forming device.

24. A method of simultaneously moving two media sheets with a drive roll in an image forming device, the method comprising the steps of:

rotating a drive roll in a first rotational direction;

moving an actuator arm operatively connected to the drive roll to a first position and positioning a diverter in a first orientation;

directing a first media sheet along a first guide edge of the diverter into a first nip formed between the drive roll and a first roll;

moving the first sheet through the first nip in a first direction and partially out of the image forming device;

reversing the drive roll to a second rotational direction and pulling the first sheet moving in a second direction in the first nip into the image forming device;

moving the actuator arm to a second position and positioning the diverter in a second orientation; and directing the first sheet moving in the second direction out of the first nip and into a duplexing path while simultaneously directing a second media sheet into a second nip formed between the drive roll and a second roll.

25. The method of claim 24, further comprising rotating the drive roll and moving the first sheet in the second direction out of the first nip and moving the second sheet in the first direction out of the second nip and out of the image forming device.

26. A method of simultaneously moving two media sheets with a drive roll in an image forming device, the method comprising the steps of:

determining a bendability of a first media sheet;

directing the first media sheet moving along a first media path and contacting a leading edge against the drive roll;

rotating the drive roll in a first rotational direction and moving the leading edge along the drive roll and into a first nip formed between the drive roll and a first roll;

reversing the drive roll to a second rotational direction while the first media sheet is within the first nip;

while the first media sheet is within the first nip, directing a second media sheet moving along the first media path and contacting the second media sheet leading edge against the drive roll and into a second nip formed between the drive roll and a second roll; and rotating the drive roll and simultaneously moving the first media sheet in a first direction out of the first nip and moving the second media sheet in a second direction out of the second nip.

27. A method of moving media sheets within an image forming device, the method comprising the steps of:

determining a bendability of a first media sheet;

moving the first media sheet along a first media path and through a first nip formed between a drive roll and a first roll with the drive roll rotating in a first direction;

determining the bendability of a second media sheet to be higher than the first media sheet; and moving the second media sheet along a second media path and through a second nip formed between the drive roll and a second roll with the drive roll rotating in a second direction, the second media path having a smaller curvature than the first media path.

* * * * *